US006536977B1

(12) United States Patent
Hammel

(10) Patent No.: US 6,536,977 B1
(45) Date of Patent: Mar. 25, 2003

(54) DISPENSER FOR SHAVING CREAM

(76) Inventor: Marsha Hammel, 1901 Kanuga Rd., Henderson, NC (US) 28739

( * ) Notice: Subject to any disclaimer, the term of this patent is extended or adjusted under 35 U.S.C. 154(b) by 0 days.

(21) Appl. No.: 09/903,263

(22) Filed: Jul. 11, 2001

Related U.S. Application Data

(60) Provisional application No. 60/223,948, filed on Aug. 9, 2000.

(51) Int. Cl.[7] ..... B43K 5/00

(52) U.S. Cl. ..... 401/205; 401/183; 401/263; 401/198

(58) Field of Search ..... 44/205, 183, 185, 44/184, 261, 263, 186, 198

(56) References Cited

U.S. PATENT DOCUMENTS

| | | | | |
|---|---|---|---|---|
| 420,785 | A | 2/1890 | Gustafson | |
| 1,222,875 | A | 4/1917 | Lerch | |
| 1,929,884 | A | 10/1933 | Fisher | |
| 1,970,831 | A | 8/1934 | Allen | |
| 2,048,689 | A | 7/1936 | Feasel | |
| 2,180,004 | A | 11/1939 | Grant | |
| 2,307,224 | A | 1/1943 | Kingman | |
| 2,622,258 | A | 12/1952 | Giraud | |
| 3,106,742 | A | 10/1963 | Schultz et al. | |
| 3,512,681 | A | 5/1970 | Frankel | |
| 4,475,838 | A | * 10/1984 | Cropton | 401/186 |
| 4,961,521 | A | 10/1990 | Eckman | |
| 5,018,894 | A | 5/1991 | Goncalves | |
| 5,052,567 | A | 10/1991 | Colami | |
| 5,156,285 | A | 10/1992 | Zogg et al. | |
| 5,299,877 | A | 4/1994 | Birden | |
| D373,085 | S | 8/1996 | Lecoule | |
| 5,944,032 | A | * 8/1999 | Materson | 401/183 |
| 5,988,923 | A | 11/1999 | Arai | |
| D418,421 | S | 1/2000 | Mansau | |
| 6,095,705 | A | 8/2000 | Phillips | |

FOREIGN PATENT DOCUMENTS

| | | |
|---|---|---|
| GB | 18883 A | of 1908 |

* cited by examiner

*Primary Examiner*—David J. Walczak
(74) *Attorney, Agent, or Firm*—Harness, Dickey & Pierce, P.L.C.

(57) ABSTRACT

A dispenser for dispensing shaving liquids/gels. The dispenser has a tubular member and a closure member. The closure member is fitted above the tubular member with the help of threaded grooves. The tubular member of the dispenser has indentations to provide a firm grip of the dispenser especially when used in bath or shower. In order to dispense the liquid, openings are formed on the tubular member and the closure member. The closure member can be rotated from a use position, where the openings are aligned with each other, to a non-use position where the openings are opposite each other. A nylon mesh sponge is attached to the closure member to aerate and foam the liquid and to avoid wetting of hands while the shaving liquid/gel is being applied to the affected area of skin.

19 Claims, 3 Drawing Sheets

DISPENSER FOR SHAVING CREAM

This application claims the benefit of provisional application No. 60/223,948, filed Aug. 9, 2000.

FIELD OF THE INVENTION

The present invention relates to a flexible dispenser for dispensing liquids. In particular the invention relates to a flexible dispenser for dispensing shaving gel which is easy to grip while shaving.

BACKGROUND OF THE INVENTION

Today most men and women shave using a dispenser wherein a shaving liquid or gel is dispensed from the dispenser directly into the user's hand. One of the major drawbacks of using such a dispenser is that the shaving liquid or gel cannot be directly applied to the area of skin to be shaved. In such an application, the user must first dispense the liquid or gel into the palm of his or her hand and then apply it to the area of skin to be shaved. This results in the user's hand being wet, slippery and messy. Because of wet hands, the user cannot firmly grip the dispenser or a razor and may suffer cuts and nicks while shaving, especially if shaving in a bath or shower.

In addition, most shaving gel dispensers are metal canister-type dispensers, wherein the dispensing apparatus is comprised of a rubber bladder with metal ribs, as well as a propellant. The disadvantages of this metal canister-type dispenser are two-fold. First, the dispensing apparatus is relatively complex and costly to manufacture. Secondly, the dispensing apparatus of a metal canister-type dispenser does not permit all of the shaving gel to be dispensed. A significant amount of shaving gel is left wasted in the bottom of the metal canister-type dispenser.

SUMMARY OF THE INVENTION

It is an object of the present invention to design and manufacture a dispenser for dispensing shaving gel wherein the gel can be directly applied to the area of skin to be shaved. It is another object of the present invention to provide a dispenser that is easy to grip while shaving, especially if shaving in a shower or bath.

It is a further object of the present invention to design and manufacture a dispenser which dispenses nearly the full amount of shaving gel, leaving very little shaving gel wasted in the bottom of the dispenser.

These and other objects are obtained by providing further areas of applicability of the present invention as will become apparent from the detailed description provided hereinafter. It should be understood however that the detailed description and specific examples, while indicating preferred embodiments of the invention, are intended for purposes of illustration only, since various changes and modifications within the spirit and scope of the invention will become apparent to those skilled in the art from this detailed description.

In accordance with the present invention, a preferred embodiment of a shaving gel or liquid dispenser is comprised of a tubular member and a closure member. The tubular member is comprised of a body, a neck, two sidewalls and a base. A shaving liquid or gel is filled inside the tubular member. A flexible member extends from one sidewall to the other, sealing the top of the tubular member. A first opening is formed on the flexible member. The neck portion of the tubular member defines screw threads.

The closure member of the present invention is comprised of a top wall and a downwardly extending annular skirt/collar. A second opening is formed on the top wall of the closure member. Threaded grooves are provided on the annular skirt/collar of the closure member. An inner disc section provides a third opening and is formed between the top wall and the treaded grooves. A sponge is attached through this second opening to this inner disc section of the closure member. This sponge is comprised of a fine nylon mesh, commonly known as tulle.

When the dispenser is in use, the first and the third openings are aligned and the shaving liquid or gel may flow from the tubular member, through the closure member and contact the nylon sponge. When the nylon sponge is applied to the skin, the shaving gel becomes aerated and transforms into a foam suitable for shaving. When the dispenser is not in use, the first and the third openings are situated in an opposite direction from the other, preventing the shaving liquid or gel from flowing from the tubular member through the closure member to the sponge. Thus, the closure member may be rotated from a use position, where the first and third openings are aligned, to a non-use position, where the first and third openings are situated in an opposite direction from the other. It is yet another aspect of the present invention to provide stop members in the treaded grooves of the closure member to limit further rotation of the closure member when the desired position of use or non-use is reached.

The dispenser of the present invention is advantageous over previously designed dispensers in that the present invention allows for the shaving gel or liquid to be directly applied to the area of skin to be shaved. Thus, the present invention eliminates the need for wasteful and slippery smearing of the liquid or gel in the palm of the user's hand before applying to the affected area. Moreover, the present invention advantageously provides a dispenser that is easy to grip while shaving especially in a shower or bath. Finally, the present invention provides a shaving gel dispenser which dispenses nearly the full amount of shaving gel, leaving little gel wasted in the bottom of the dispenser.

Additional advantages and features of the present invention will become apparent from the following description and appended claims, taken in conjunction with the accompanying drawings.

DESCRIPTION OF THE PREFERRED EMBODIMENT

Figure 1:
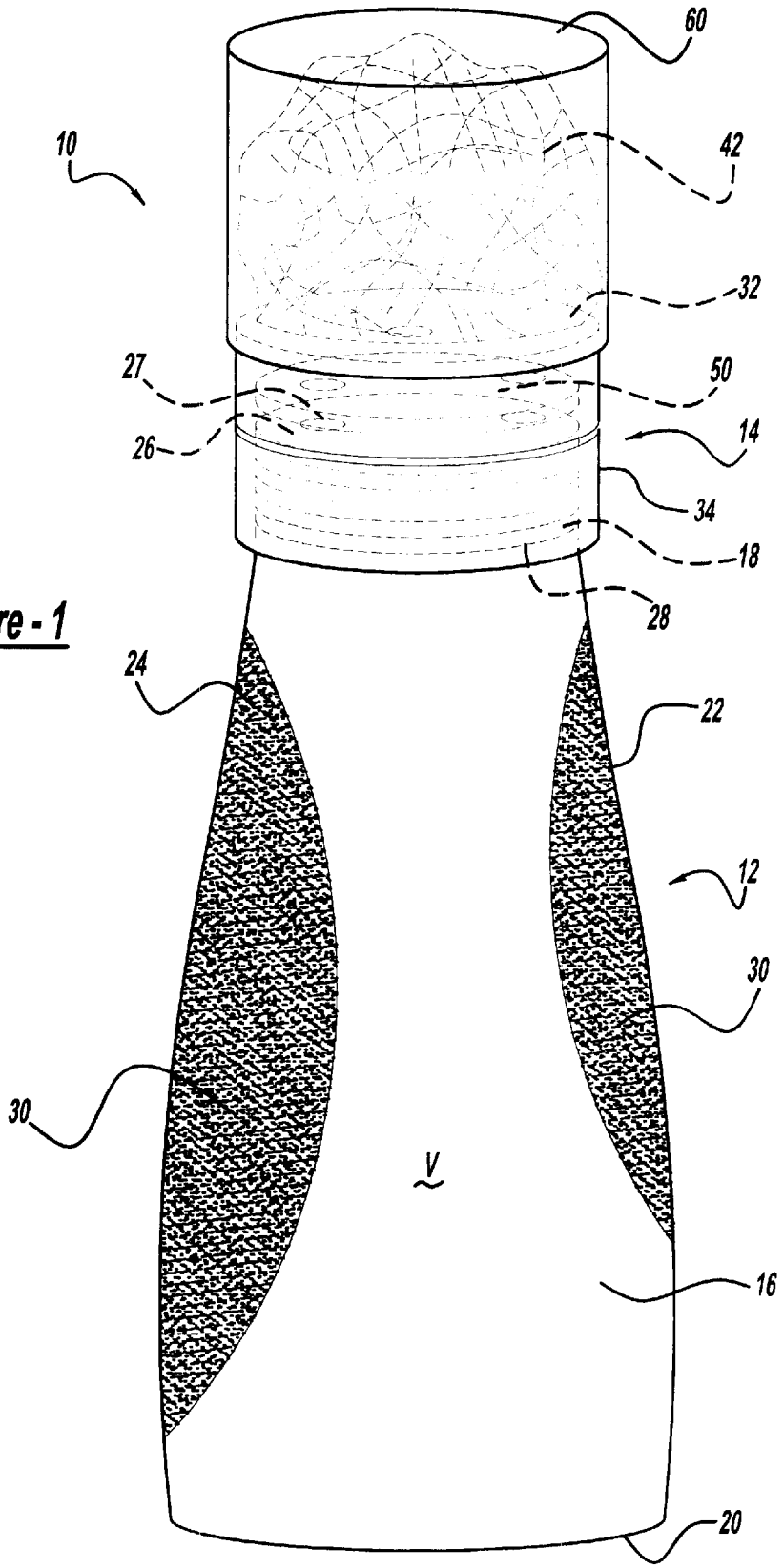
FIG. 1, is an elevated front view of the dispenser in accordance with the teachings of the present invention.
Figure 2:
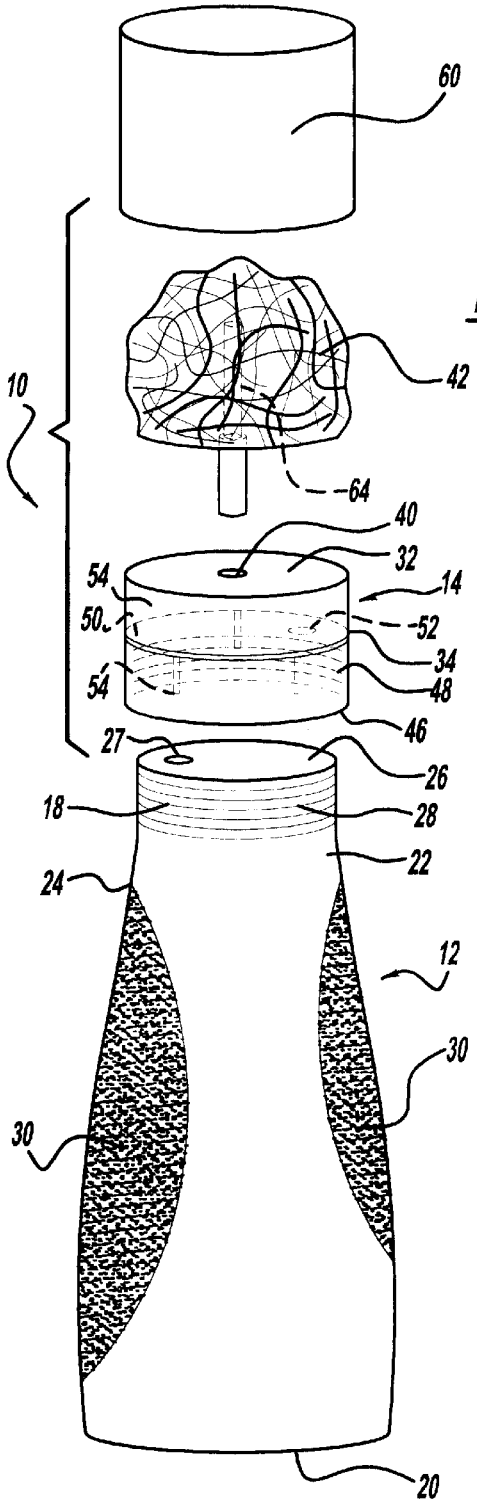
FIG. 2 is an expandable front view of the dispensing mechanism in accordance with the teachings of the present invention.

Referring in particular to FIGS. 1 and 2, a dispenser 10 having a tubular member 12 and a closure member 14, are shown in accordance with the teachings of the present invention. The tubular member 12 has a body 16, an upper neck 18, a base 20 and two side-walls 22, 24. In the preferred embodiment, the base 20 of the tube has a larger diameter than the upper neck 18 of the tubular member 12. In the preferred embodiment, the body 16 has a narrow profile such that the dispenser is easy to store. A volume V is defined inside the dispenser by the side-walls 22, 24 and the base 20. A shaving liquid or gel (not shown) is filled within the volume V.

In order to dispense the liquid in the appropriate amount and to seal the top of the tubular member 12, a flexible member 26 extends across from one side-wall 22 to the other side-wall 24. The flexible member 26 has a first opening 27. In the preferred embodiment as shown in FIGS. 1 and 2, the first opening 27 is off centered towards one of the side-walls 24. The first opening 27 is of sufficient size to allow the shaving liquid or gel to flow from the tubular member 12 through the opening 27. In the preferred embodiment, the size of the opening 27 is approximately $1/8^{th}$ of an inch. However, the size of the opening 27 can vary depending on the amount of liquid required to be dispensed. The upper neck 18 of the tubular member 12 has screw threads 28 formed on the outside of the body 16. The function of the screw threads 28 will be described in detail later.

Referring in particular to FIGS. 1 and 2, in order to enable easy gripping of the tubular member 12, the side-walls 22, 24 each have an indentation 30. The indention 30 is approximately two inches in length and formed on the side-walls 22, 24 between the neck 18 and base 20. Preferably the indentation is textured to allow a non-slip grip of the dispenser 10. As shown in FIG. 1, the textured indentation 30 on the side-walls 22, 24 may be formed in the middle portion between the neck 18 and the base 20 parallel to each other, or one of the indentations 30 may be lower than the other. In the preferred embodiment, the textured indentations 30 are placed such that it is easy for a user to wrap his or her fingers in a firm grasp around the entire dispenser 10. The textured indentations 30 can be made of a more flexible material than the tubular member 12. This provides an easy squeeze of the dispenser 10 to allow the shaving liquid or gel to easily flow out of the tubular member.

Figure 2A:
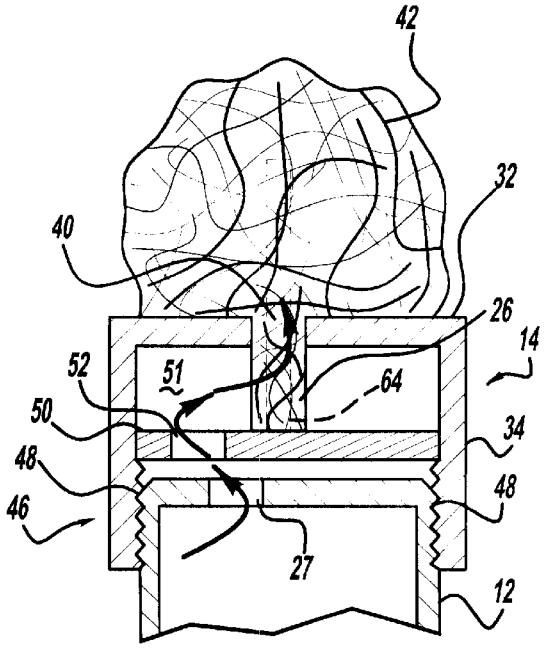
FIG. 2*a* is a cross-sectional view of the closure member of the present invention showing flow of the shaving liquid.
Figure 2B:
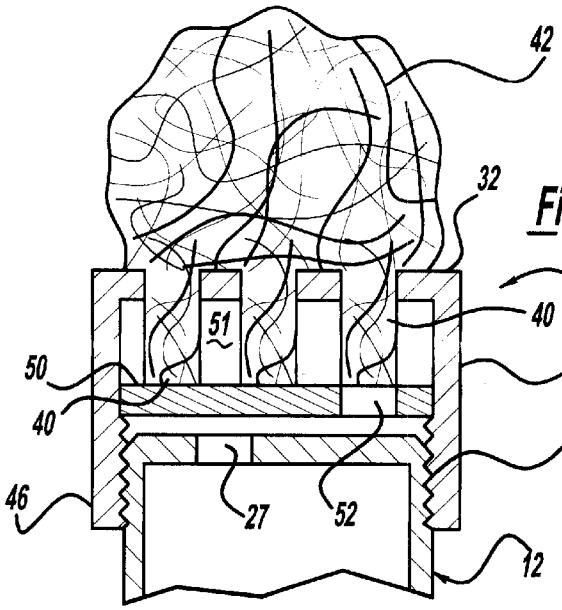
FIG. 2*b* is a cross-sectional view of the closure member of the present invention showing an embodiment of the present invention wherein the nylon mesh sponge is attached to the closure member through a plurality of openings.
Figure 2C:
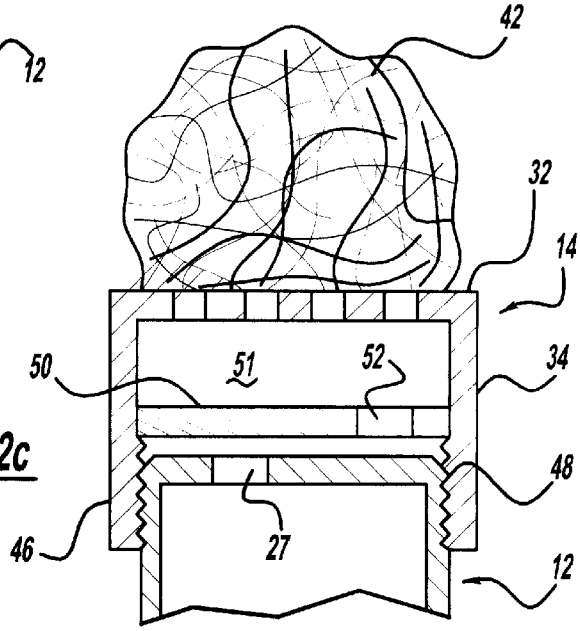
FIG. 2*c* is a cross-sectional view of the closure member of the present invention showing an embodiment of the present invention wherein the nylon mesh sponge is attached directly to the top wall of the closure member.

As shown in FIGS. 2 to 2*c*, the closure member 14 caps the tubular member 12. The closure member 14 comprises a top wall 32 and an annular skirt/collar 34 which extends downwardly from the top wall 32.

The closure member 14 comprises a second opening 40 that is formed on the top wall 32. In the preferred embodiment, the second opening 40 is formed in the center of the top wall 32. However, the second opening 40 may be formed anywhere on the top wall 32. In addition, a plurality of second openings 40 may be formed on the top wall 32, as shown in FIG. 2*b*. In the preferred embodiment, the second opening 40 is approximately $1/8^{th}$ of an inch and of the same size as the first opening 27.

Grooves 48 are formed on the lower end 46 of the annular skirt 34. The grooves 48 formed on the annular skirt 34 correspond to the screw threads 28 formed on the neck 18 of the tubular member 12. An inner disk member 50 is placed between the grooves 48 and the top wall 32. A chamber 51 is thus defined between the top wall 32 and the inner disk member 50. A third opening 52 is formed on the inner disk member 50. The third opening 52 is formed such that in one position, the third opening 52 and the first opening 27 are in opposite position from the other. In another position, the third opening 52 and the first opening 27 are aligned with each other. The third opening 52 is of the same size as the first opening 27. In the preferred embodiment the size of the opening is approximately $1/8^{th}$ of an inch. The grooves 48 on the annular skirt 34 have stop members 54 formed on them. The stop members 54 prevent further rotation of the closure member 14, when the third opening 52 and first opening 27 reach the desired position.

Referring in particular to FIG. 2*a,* in order to apply the shaving liquid/gel to the affected area of skin, a nylon mesh sponge 42 is threaded through the second opening 40 and attached by adhesive to the inner disk member 50. In another embodiment of the present invention, the nylon mesh sponge is threaded through a plurality of openings located on the top wall 32, as shown in FIG. 2*b*. In addition, the nylon mesh sponge 42 may also be attached directly to the top wall 32 using adhesives, as shown in FIG. 2*c*.

Figure 3:
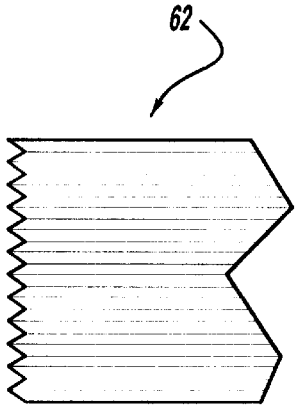
FIG. 3, is a perspective view of the fan folded nylon material which forms the sponge of the present invention.

Referring in particular to FIG. 3, the nylon mesh sponge 42 is formed from fan-folded nylon mesh fabric 62, commonly known as tulle. In the preferred embodiment, the nylon mesh fabric 62 measures approximately six inches by twenty inches. The fabric 62 is fan-folded lengthwise into about twelve folds. measuring approximately on-half of an inch each, The fan-folded fabric 62 is then folded again, widthwise. A nylon thread 64 is then threaded through the fan-folded fabric 62 and cinched, securing the fabric fans. The fans are then separated and fluffed into the shape of the sponge.

The dispenser 10 may be closed by a cap 60, which can be snap fitted or friction fitted over the closure member 14. In the preferred embodiment the cap 60 is transparent. The main purpose of the cap 60 is to enhance the aesthetic feature of the dispenser 10 and to keep the nylon sponge clean.

Referring in particular to FIG. 2*a,* the dispenser 10 is used to dispense shaving liquid/gel in the following manner. The closure member 14 is attached to the tubular member 12 with the help of the screw threads 28 and grooves 48, such that the closure member 14 caps the tubular member 12. In a non-use position, the first opening 27 on the flexible member 26 and the third opening 52 on the inner disk member 50 are not aligned, as shown in FIG. 1. While in use, the closure member 14 is rotated such that the first opening 27 and third opening 52 are aligned with each other, as shown in FIG. 2*a*. The stop members 54 on the annular skirt 34 will lock the closure member 14 when the openings 27, 52 are aligned with each other and will prevent further rotation of the closure member 14. When the dispenser 10 is squeezed in the area of the textured indentation 30, the shaving liquid or gel readily flows out of the tubular member 12, through the first opening 27, through the third opening 52 to fill the chamber 51 between the inner disk member 50 and the top wall 32. Once the liquid fills the chamber 51, it may flow through the second opening 40 and contact the nylon mesh sponge 42. The nylon mesh sponge 42 aerates the liquid, creating a foam to be applied to the skin, Therefore, the present invention allows the shaving liquid or gel to be directly applied to the affected skin area without wetting the hands. The textured indentation serves the dual purpose of allowing a user to firmly grip the dispenser and an easy squeeze of the bottle.

The foregoing discussion discloses and describes a preferred embodiment of the invention. One skilled in the art will readily recognize from such discussion and from the drawings and claims that changes and modifications can be made without departing from the true spirit and scope of the invention as defined in the following claims.

What is claimed is:

1. A dispenser containing a liquid comprising:

a tubular portion having a first opening;

a closure portion coupled to said tubular portion, wherein said closure portion has a second opening;

an inner disc portion disposed within the closure portion having a third opening, said closure portion adapted to be rotated from a first position to a second position wherein said first and third openings are substantially aligned when said closure portion is in said first position and said first and third openings are not aligned when said closure portion is in said second position;

a grip portion formed on said tubular portion; and a mesh sponge threaded through said second opening and coupled within said closure portion.

2. The dispenser of claim 1 wherein said tubular portion is comprised of a body, an upper neck, a base, two sidewalls, and a flexible member with a first opening.

3. The dispenser of claim 2 wherein said tubular portion includes screw threads formed on the outside of said upper neck.

4. The dispenser of claim 1 wherein said closure portion is comprised of a top wall, an annular skirt and a second opening.

5. The dispenser of claim 4 wherein grooves are formed on said annular skirt.

6. The dispenser of claim 4 wherein said nylon mesh sponge is attached directly to said top wall.

7. The dispenser of claim 1 wherein said grip portion is textured for a non-slip grip of said dispenser.

8. The dispenser of claim 1 wherein said mesh sponge is comprised of a length of fan folded nylon mesh fabric.

9. The dispenser of claim 8 wherein a nylon thread is threaded through said fan folded nylon mesh fabric.

10. A dispenser containing a liquid comprising:

a tubular portion having a first opening;

a closure portion coupled to said tubular portion, wherein said closure portion has a second opening;

an inner disc portion disposed within the closure portion having a third opening, wherein said closure portion is adapted to be rotated from a first position to a second position and wherein said first and third openings are aligned when said closure portion is in said first position and said first and third openings are in an opposite direction when said closure portion is in said second position;

a flexible grip portion formed on said tubular portion; and a nylon mesh sponge threaded through said second opening and coupled directly to said inner disc portion.

11. The dispenser of claim 10 wherein said tubular portion is comprised of a body, an upper neck, a base, two sidewalls, and a flexible member.

12. The dispenser of claim 11 wherein said first opening is located on said flexible member.

13. The dispenser of claim 12 wherein said tubular portion includes screw threads formed on the outside of said upper neck.

14. The dispenser of claim 10 wherein said closure portion is composed of a top wall and an annular skirt.

15. The dispenser of claim 14 wherein said second opening is located on said top wall.

16. The dispenser of claim 15 wherein grooves are formed on said annular skirt.

17. The dispenser of claim 15 wherein said inner disc portion is located between said grooves and said top wall.

18. The dispenser of claim 10 wherein said flexible grip portion is textured for a non-slip grip of said dispenser.

19. The dispenser of claim 1 wherein said mesh sponge is coupled directly to said inner disc portion.

* * * * *

UNITED STATES PATENT AND TRADEMARK OFFICE

CERTIFICATE OF CORRECTION

PATENT NO. : 6,536,977 B1 
DATED : March 25, 2003
INVENTOR(S) : Marsha Hammel

It is certified that error appears in the above-identified patent and that said Letters Patent is hereby corrected as shown below:

Column 4,
Line 22, "folds." should be -- folds, --.
Line 22, "on-half" should be -- one half --.
Line 23, "each," should be -- each. --.
Line 56, "skin," should be -- skin. --

Column 6,
Line 24, "composed" should be -- conprised --.

Signed and Sealed this

Thirtieth Day of September, 2003

JAMES E. ROGAN
*Director of the United States Patent and Trademark Office*